US006691667B2

(12) United States Patent
Salameh

(10) Patent No.: US 6,691,667 B2
(45) Date of Patent: Feb. 17, 2004

(54) CASING COVER HAVING AN ACOUSTICALLY DECOUPLED STOP

(75) Inventor: Ralf Salameh, Bretten (DE)

(73) Assignee: Federal-Mogul Sealing Systems Bretten GmbH & Co. KG, Bretten (DE)

( * ) Notice: Subject to any disclaimer, the term of this patent is extended or adjusted under 35 U.S.C. 154(b) by 0 days.

(21) Appl. No.: 10/227,286

(22) Filed: Aug. 26, 2002

(65) Prior Publication Data

US 2003/0037756 A1 Feb. 27, 2003

(30) Foreign Application Priority Data

Aug. 24, 2001 (DE) ..... 101 41 569

(51) Int. Cl.[7] ..... F02F 7/00

(52) U.S. Cl. ..... 123/195 C; 123/90.38; 181/204; 277/313

(58) Field of Search ..... 123/90.38, 195 C; 181/204; 277/313

(56) References Cited

U.S. PATENT DOCUMENTS 5,255,647 A 10/1993 Kiczek

FOREIGN PATENT DOCUMENTS

| | | |
|---|---|---|
| DE | 31 13 912 A1 | 10/1982 |
| DE | 34 27 529 A1 | 2/1986 |
| DE | 297 15 719 U1 | 1/1998 |
| EP | 0 664 388 A1 | 7/1995 |

OTHER PUBLICATIONS

Japanese Patent Abstract No. 59–101568, (Jun. 12, 1984), Shigeru, "Mounting Construction Of Oil Pan In Engine".

*Primary Examiner*—Noah P. Kamen
(74) *Attorney, Agent, or Firm*—Venable LLP; Stuart I. Smith

(57) ABSTRACT

A casing cover (1, 10, 22) for an internal-combustion engine, particularly valve covers or oil pans, to be mounted detachably and fluid-tight to an engine block (5, 13, 23), having an elastomer seal profile (3, 12, 28) disposed at the peripheral edge (2, 11) of the casing cover (1, 10, 22), and an inside (6, 17), axial extension (7, 14, 26) oriented in the direction of the engine block (5, 13, 23) disposed at the edge (2, 11) of the casing cover (1, 10, 22). The extension projects axially beyond the sealing surface (4, 15) of the engine block when the cover is installed, and a seal (20, 29) is disposed at least between the axial extension (7, 14, 26) and the engine block (5, 13, 23).

12 Claims, 1 Drawing Sheet

CASING COVER HAVING AN ACOUSTICALLY DECOUPLED STOP

CROSS-REFERENCE TO RELATED APPLICATION

This application claims the priority of German Patent Application No. DE 101 41 969.9 filed Aug. 24, 2001, which is incorporated herein by reference.

This application is related to concurrently filed U.S. patent application No. 10/227,451 corresponding to German Patent application No. DE 101 41 570.0, filed Aug. 24, 2001, which is incorporated herein by reference.

BACKGROUND OF THE INVENTION

The invention relates to a casing cover for an internal-combustion engine, particularly valve covers or oil pans to be mounted detachably and fluid-tight to an engine block, with an elastomer seal profile at the edge of the casing cover.

In engines, especially internal-combustion engines, it is unavoidable that a component, such as the engine block, will vibrate during engine operation. These vibrations may lead to an unpleasant noise level. A common measure for preventing the component vibrations from being transmitted to the parts adjoining the vibrating component, or only allowing them to be transmitted in damped form, is to integrate elastomer seal profiles into the adjoining parts, which assure an acoustic decoupling of the adjoining parts. This measure can often greatly reduce the noise level. The parts mounted to the component primarily include casing covers, such as valve covers or oil sump covers, i.e., oil pans, in internal-combustion engines. In this acoustic decoupling of the casing cover, a profiled elastomer seal is positioned between the casing cover and the engine block. The surface of the engine block on which the seal profile rests is referred to as the sealing surface.

A drawback of this use of elastomers is that they are prone to a more or less significant amount of relaxation. The relaxation is counteracted with, among other measures, combined decoupling devices.

By way of example, U.S. Pat. No. 5,255,647 proposes a vibration-decoupling device for a casing cover, in which, in addition to a screw decoupling, a decoupling element is disposed as a seal profile in the cover edge. In this case, the seal profile serves in sealing a space inside the casing cover, as well as in vibration-related decoupling between the casing cover and the engine block, while the screw decoupling serves to counteract the seal relaxation and the associated risk of leakage.

If such casing covers are produced from plastic, the generally low rigidity of plastic as compared to metal gives rise to the risk of displacement, that is, drifting as a result of relaxation or deformation of the edge of the casing cover between the fastening screws. Of course, it is also possible for metal casing covers to be displaced. While the screw decoupling counteracts a relaxation of the seal profile, it offers no assurance that the cover edge will not be displaced across the sealing surface.

For counteracting the relaxation of the seal profile, European published patent application No. EP 0 664 388 A1 proposes a generic casing cover as a valve cover for a cylinder head of an internal-combustion engine, in which the pre-stressing force on the seal can be adjusted with the use of a metallic spring body. In this instance, the seal profile at the cover edge is pressed against the engine block with a specific force during the tightening process. With the use of the metallic spring body, the valve cover is in a position to follow the relaxation of the seal profile.

A disadvantage of this casing-cover design is that, while the force on the seal can be maintained at a relatively constant level, there is no provision for preventing a shifting movement of the cover edges across the sealing surface. Shifting fatigue of the casing-cover material, for example, or excessive tightening moments of the cover screws. This is particularly the case when the casing-cover materials are insufficiently stable, the components cannot be constructed to be adequately rigid, or the screw arrangement is unfavorable.

The seal may be damaged by the shifting movement, or the sealing forces on the elastomer seal material may no longer suffice to prevent leaks.

SUMMARY OF THE INVENTION

It is therefore the object of the present invention to provide a casing cover that counteracts the shifting movements of the cover casing, and is provided with an acoustic decoupling mechanism.

The above object generally is achieved according to the present invention by a casing cover for an internal-combustion engine, particularly a valve cover or an oil pan, to be mounted detachably and fluid-tight to an engine block, with the cover having: a peripheral edge that is profiled to receive an elastomer seal and has an edge surface for engaging a sealing surface of an engine block; an axial extension disposed at an inner portion of the edge surface of the ceasing cover and oriented in the direction of an engine block, with the extension projecting axially beyond the edge surface of the casing cover and positioned so that the extension will extend beyond the sealing surface on the engine block when installed and at least correctly position the casing cover on an engine block; and a seal provided at least on an outer surface of the extension so as to provide a seal between the axial extension and the engine block when the cover is installed on an engine block. Advantageous modifications of the invention likewise are provided and discussed.

The concept underlying the invention overcomes the above-described technical drawbacks by providing an axial extension on the inside of the edge of the casing cover, with the extension being oriented in the direction of the engine block and projecting axially beyond the sealing surface when the casing cover is installed on the engine block, and at least one seal is disposed between the axial extension and the engine block.

The axial extension of the casing cover in accordance with the invention effectively prevents shifting movements of the cover edge. Instead, it is possible to manipulate the position of the cover on the sealing surface of the engine block. This purposeful positioning offers the advantage that the sealing surface on the engine block can be adapted exactly to the shape of the elastomer seal-profile material. This leads in turn to material savings with respect to the sealing surface, which positively influences the engine weight, A further advantage is that the extension of the casing cover permits a purposeful, defined introduction of force into the elastomer sealing material, so the occurring tensions can be calculated and adjusted more reliably.

In addition to these advantages, the extension of the casing cover serves as a joining aid in the assembly process, and aids in positioning the casing cover during the mounting process. If, in accordance with the invention, the extension is formed such that it fixedly clamps the casing cover during the joining process, this greatly facilitates overhead assembly, as may be employed for oil pans.

In a first embodiment, the extension is disposed around the entire peripheral edge of the cover. Depending on the application and structural conditions, the extension can also only be formed only along part of the cover peripheral edge. The advantage of the partial embodiment is a lower weight, while the all-around embodiment offers more reliable guidance.

The extension projects beyond the sealing surface, in the direction of the engine block, and, in accordance with the invention, is shaped to engage an undercut in the inner wall of the engine block.

According to the invention, partial and all-around undercut engaging shapes are both conceivable. In fact, any undercut shape is conceivable, provided that the casing cover is detachable and is formed to be detached without damaging the extension. For example, rounded areas at the ends of the extension facilitate the joining of the casing cover.

In a further embodiment of the invention, the undercut engaging portion of the extension is formed in the shape of a sloped portion. The slope begins at the inside of the casing cover and extends in the direction of the outside of the casing cover and toward the inner wall of the engine block. The undercut engaging shape in the form of a slope offers the advantage that, in the event that the cover edge is shifted, the casing cover is drawn in the direction of the sealing surface, which simultaneously increases the sealing force. This advantageous effect can be utilized to influence the relationship between the shifting movement and the buildup of sealing forces. The undercut engaging shape in the form of a slope further offers the option of exerting a pre-stress on the seal profiles of the casing cover, thereby effecting a very precise positioning in the joining phase, which can in turn be beneficial for automated mounting procedures.

The arrangement of a further eloped portion at the axial lower end of the extension of the cover edge, with the further sloped portion being oriented in the opposite direction of the first slope, centers the casing cover in the joining phase. This greatly facilitates the handling of the casing cover in automated assembly processes.

Depending on the established dimensional tolerance, an additional sealing function can be realized through the production of the extension of the cover edge. This would be of great advantage if, for example, the fastening screws were inadequately tightened, giving rise to the risk of leakage.

In accordance with the invention, a structural adaptation between the sealing surface on the engine block and the extension of the casing cover can also simplify the joining of the casing cover. Thus, it is conceivable to provide a chamfer on the engine block to allow the extension to latch into the engine block.

The casing cover can comprise arbitrary materials, but, in accordance with the invention, it is preferably produced from a plastic. The extension according to the invention avoids the relaxation occurring in plastics, and the associated shifting movements of the seals on thee sealing surface.

To prevent the extension from coming into direct contact with the engine block, a further seal is disposed on the outer surface of the extension between the axial extension and the engine block, or the existing seal profile is formed or extended across the sealing surface and up to the end of the axial extension. If a further seal is provided as a separate part, the seal can be secured either in a form-fit or a non-positive lockup. A form-fit would be, for example, a seal in the shape of a U, with the two legs being pushed past the axial lower end of the extension. The adjustment of the leg spacing allows the stability of the seal seat to be adjusted. In a non-positive lockup, it is conceivable to secure the seal to the outer surface of the extension using a vulcanizing or injection-molding method.

In a further embodiment of the invention, the seal profile is formed to extend across the sealing surface and up to the end of the axial extension. The advantage of this embodiment lies in the lower cost of the seal assembly. Form-fit and non-positive-lockup connections are also conceivable here.

The arrangement of a seal between the extension and the engine block prevents the casing cover from coming into contact with the engine block when vibrations occur during engine operation. The casing cover thus is acoustically decoupled.

Exemplary embodiments of casing covers are described in detail below in conjunction with drawings and the ensuing description.

DESCRIPTION OF THE PREFERRED EMBODIMENTS

Figure 1:
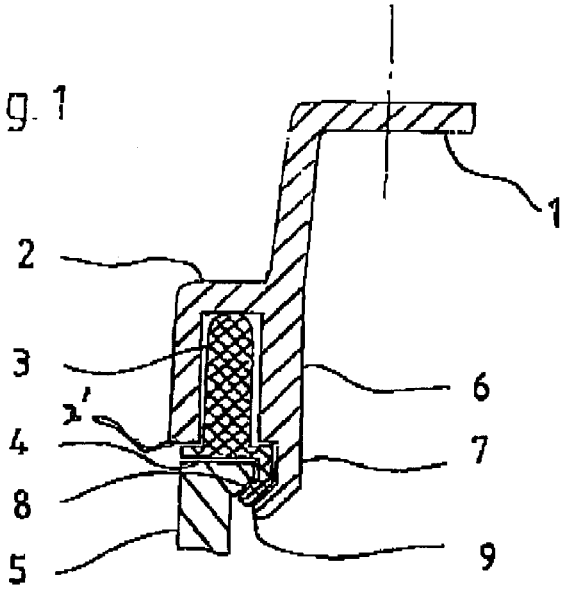
FIG. 1 is a partial cross-sectional view of an embodiment of a casing cover according to the invention, having an extension with an undercut engaging shape in the form of a sloped portion and with a one-piece seal arrangement in the cover edge and between the extension and the engine block.

FIG. 1 is a section through a casing cover 1 in accordance with the invention. The casing cover 1 comprises a peripheral cover edge 2 that is profiled to receive a profiled elastomer seal 3, with the seal profile 3 extending beyond the end surface 2' of the edge and resting on the sealing surface 4 of the engine block 5. The inside cover edge 6 of the casing cover 1 is provided with an axial extension 7, which projects beyond the cover end surface 2' and the sealing surface 4 when the cover is installed on an engine block. The extension 7 is formed so as to engage an undercut 8 in the inner wall of the engine block 5. In this embodiment, the undercut 8 is shown in the form of a sloped surface, and the extension 7 has a sloped portion 9 that can engage the undercut 8.

In this embodiment, the profile of seal 3 is formed in one piece, and extends from the sealing surface 4 along the outer surface of the extension 7 to the end 10 of the extension 7.

Figure 2:
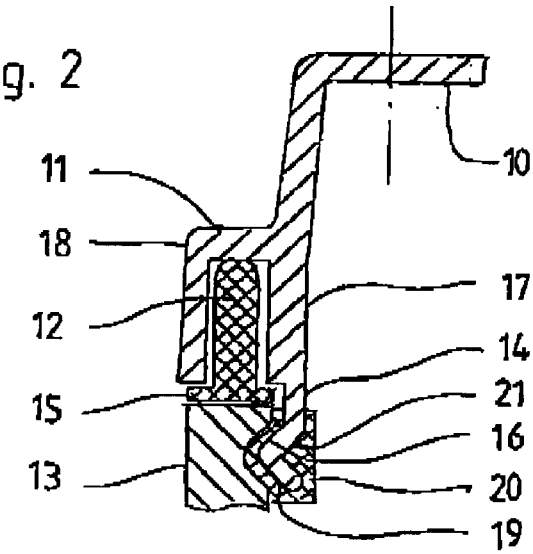
FIG. 2 is a partial cross-sectional view of a further embodiment of a casing cover according to the invention, having an extension with an undercut engaging shape in the form of a sloped portion with a further sloped portion, which extends from the end of the first sloped portion in the opposite direction of the first sloped portion, and a separate seal provided on the extension.

FIG. 2 is a section through a casing cover in having a cover edge 11, an elastomer seal profile 12 and an engine block 13. The extension 14 at the cover edge 11 projects beyond end surface of the cover and thus beyond the sealing surface 15 when the cover is installed, and has a sloped portion 16, which extends from the inner wall 17 of the casing cover 10 toward the outer wall 18. A further sloped portion 19, which is oriented in the opposite direction of the first sloped portion 16, is disposed to form the end of the extension 14, so the further sloped portion 19 can serve in the joining process. A seal 20 is connected in a form-fit to the extension 14, and, as shown, encloses the end of the sloped portions 16 and 19 of the extension 17.

Figure 3:
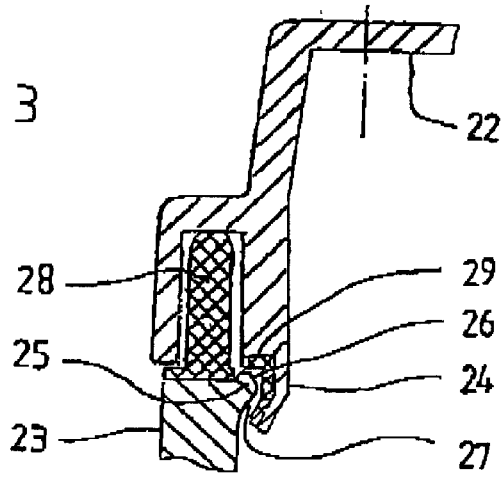
FIG. 3 is a cross-sectional view of another embodiment of a casing cover according to the invention, having an axial extension with an undercut engaging shape in the form of a sloped portion, with a structural leveled region being provided between the engine block and the extension and with a seal vulcanized onto the extension.

FIG. 3 is a section through a casing cover 22 according to the invention, in which the engine block 23 is adapted accordingly to the extension 24 The engine block 23 is provided with a chamfer 25 that facilitates the joining of the casing cover 22. The chamfer 25 has a slope 26 in the direction of the casing cover 22 for joining the casing cover, and a slope 27 in the direction of the engine block 23 for disassembling the casing cover 22. The chamfer 25 can also serve in limiting the deformation of the elastomer seal 28, and be formed correspondingly, i.e., round, in the direction of the elastomer seal 28. On the side of the engine block, a seal 29 is vulcanized onto the outer surface of the extension. This seal 29 will acoustically decouple the casing cover 22 from the engine block 23.

The invention now being fully described, it will be apparent to one of ordinary skill in the art that many changes and modifications can be made thereto without departing from the spirit or scope of the invention as set forth herein.

What is claimed is:

1. A casing cover for an internal-combustion engine to be mounted detachably and fluid-tight to an engine block, said cover having: a peripheral edge that is profiled to receive an elastomer seal and has an edge surface for engaging a sealing surface of an engine block; an axial extension disposed at an inner portion of the edge surface of the casing cover and oriented in the direction of an engine block, with the extension projecting axially beyond the edge surface of the casing cover and being positioned so that the extension will extend beyond the sealing surface on the engine block when installed; and a seal provided at least on an oater surface of the extension, so as to provide a seal between the axial extension and the engine block when the cover is installed on an engine block.

2. The casing cover according to claim 1, wherein the seal is formed as a separate part from the cover and from a seal disposed at the profiled edge of the cover.

3. The casing cover according to claim 1, wherein the seal is formed as a separate part from the cover and from a seal disposed at the profiled edge of the cover, and is connected in a form-fit to the extension.

4. The casing cover according to claim 1, wherein the seal is formed as a separate part from the cover and from a seal disposed at the profiled edge of the cover, and is connected with a non-positive lockup to the extension.

5. The casing cover according to claim 1, wherein the seal is formed as a separate part from the cover and from a seal disposed at the profiled edge of the cover, and encloses the extension.

6. The casing cover according to claim 1, wherein a profiled elastomer seal is disposed at the edge surface of the cover and this profiled seal and the seal on the extension are connected in one piece.

7. The casing cover according to claim 6, wherein the one piece elastomer seal and seal on the extension is connected to the casing cover with a non-positive lockup.

8. The casing cover according to claim 6, wherein the one piece connection of the elastomer seal and the seal on the extension is connected to the casing cover in at form-fit.

9. The casing cover according to claim 7, wherein seal is vulcanized to the extension to produce the non-positive lockup.

10. The casing cover according to claim 7, wherein the one-piece seal is injection molded to produce the non-positive lockup.

11. The casing cover according to claim 1, wherein the cover is a valve cover.

12. The casing cover according to claim 1, wherein the cover is an oil pan.

* * * * *